United States Patent [19]

Lin

[11] 4,354,448

[45] Oct. 19, 1982

[54] MANUALLY DRIVEN GENERATING MECHANISM FOR DOORBELLS

[76] Inventor: Chun N. Lin, No. 329, Chungshan Rd., Ching Shui Chen Taichung, Taiwan

[21] Appl. No.: 181,347

[22] Filed: Aug. 26, 1980

[51] Int. Cl.[3] ..... G10K 1/067

[52] U.S. Cl. ..... 116/161; 116/148; 185/37

[58] Field of Search ..... 116/161, 162, 148, 165; 185/39, 37; 74/435; 46/206

[56] References Cited

U.S. PATENT DOCUMENTS

| | | | |
|---|---|---|---|
| 260,514 | 7/1882 | Woodworth | 116/161 |
| 357,699 | 2/1887 | Colby | 116/161 |
| 3,216,529 | 11/1965 | Lohr | 185/37 X |

FOREIGN PATENT DOCUMENTS

| | | | |
|---|---|---|---|
| 625510 | 4/1927 | France | 116/148 |

*Primary Examiner*—Steven M. Pollard

*Attorney, Agent, or Firm*—Armstrong, Nikaido, Marmelstein & Kubovcik

[57] ABSTRACT

The present invention relates to an improved gyro-type manually operated dynamo mechanism applied to appliances consuming limited momentary power. Energy is stored by stressing a spring which, when released, keeps in mechanical connection with a train of acceleration gears terminating in a relatively heavy flywheel when the stressed spring is released to resume its unstressed state, and disconnects therewith when the spring reaches unstressed condition and allow the flywheel to rotate freely, thereby enhancing the exploitation of the energy stored in the flywheel in the form of inertia to produce the requisite electricity to sound the buzzer.

7 Claims, 6 Drawing Figures

MANUALLY DRIVEN GENERATING MECHANISM FOR DOORBELLS

BACKGROUND OF THIS INVENTION

The present invention concerns a mechanism adapted to house applicances which require very little power to work in use and the using time of which is transient, for example, door bells, which mechanism is manually driven to produce the requisite electricity for use.

In view of the incessantly increasing population and shrinking energy source of the world, it is predictable that the seriousness of energy crisis will only change from bad to worse in the future few years. Under such circumstance, it is critically urgent to decrease our reliance upon conventional fossil fuels.

In fact, in some appliances which consume little power because they are devised to work only momentarily rather than continuously in use, for example door bells, can be energized manually, easily, and conveniently by the user himself to bring it into work without the need for a power source, thus expelling the extra accessories such as wire and plug, or batteries, saving the consumption of cells, and obviating the trouble or replacing exhausted cells. Such devices adapt best to those places where necessities are scant due to poor transportation.

Yet known means operated manually by the user to convert his strength into available potential energy stored in mechanical devices within a transient while, and then release the energy for use within a short moment fall into two categories. The function of the first class is accomplished by compressing a spring or the like, and then releasing it to exploit the energy stored therein. Since spring resumes very fast, the period it works is too short for practical use. Although the period of work can be prolonged by mechanically connecting the spring with a accelerating gear train transmitting the motion to a relatively heavy, terminal flywheel whereby the rate of resumption of the spring is reduced in view of the relationship between mass and acceleration: $F=ma$, when the spring resumes it unstressed position, the flywheel still possess considerable inertia, which however is not practically available since the further rotation results in the stretching of the spring which, unless mechanically disconnected with the gear train immediately after it has reached its equilibrium point, will inevitably countervail the momentum of the flywheel and give rise to considerable loss in the available energy stored in the form of the inertia therein. In this case the spring is first stretched to an extent due to the inertia of the flywheel after passing its equilibrium point, and then retracts and forces the flywheel to counter-rotate. Needless to say, in the damping process, much available energy is lost.

Another class is found in friction drive toys, which is basically in common with the gyrobus in terms of their driving system involving a rapidly spinning flywheel. The ordinary manner to play with such toy by rubbing its wheels vigorously against a flat plane however, is not adapted to be applied to doorbells. Although the flywheel can be energized by rocking a crank arm connecting to the first gear of the accelerating gear train, this method is not altogether satisfactory since the crank arm appears unsightly and clumsy at door. Moreover, the manner clamping the crank arm to rock it does not coincide with ordinary habit by pushing a button or pulling a cord.

Accordingly, it is the object of the present invention to provide an improved gyro-type manually energizing mechanism to obviate and mitigate the aforesaid disadvantages.

According to an aspect of this invention the foregoing disadvantages are overcome by means of a detachable transmission mechanism which is preferably positioned between the first gear of the accelerating train gears and the device through which the force is exerted to effect the engagement and disengagement thereof, thereby exploiting the residual kinetic energy stored in the flywheel in the form of inertia.

These objects of this invention will be accompanied by embodiments as referred to in relation with the annexed drawing of this invention as following.

DETAILED DESCRIPTION OF PREFERRED EMBODIMENTS

Embodiment I

Figure 1:
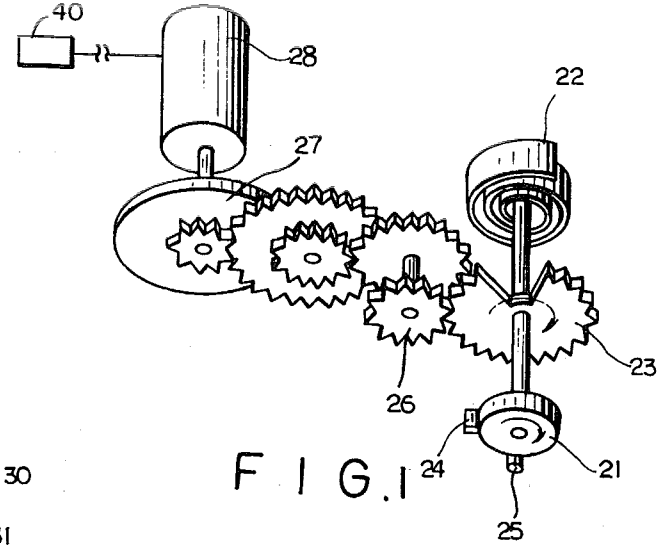
FIG. 1 is a perspective view of an embodiment according to this invention.

With reference to FIG. 1, the energy is stored in the tightly wound spiral spring (22) by twisting winding knob (21) to turn the sector gear (23) coaxially mounted on the winding shaft. Knob (21) is provided with a ward (24) which, together with the stop pin (25), prevents the undue overwinding thereof, since if the notch of sector gear is turned to meet the first gear (26) so that their teeth are no more in mesh with each other, when winding knob (21) is released, the tooth located on the edge of notch, not in mesh with anything, is first swivelled back rapidly under the resumptive force of the spiral spring, and strikes the teeth of gear (26) before it meshes with the latter, thus giving rise to the wear of their teeth. For this reason, stop pin (25) should be so positioned that when ward (24) is turned to stop pin (25) and is hampered thereby, sector gear (23) still keeps in mesh with gear (26).

When the windup knob (21) is released, the resilience of spiral spring will force sector gear (23) to counter-rotate, to drive flywheel (27) mounted on the rotary shaft of a dynamo (28) through the transmission of a train of gears to produce an electric current with a voltage of 4–8 volt which is far enough to sound a buzzer 40. When spiral spring (22) resumes its unstressed condition, meanwhile the notch of sector gear (23) has already reached the meshing position of sector gear (23) and gear (26) and resulted in the disengagement thereof, thus leaving flywheel (27) spinning freely for a moment until it gradually slowing down, and making the best of the residual kinetic energy stored in the flywheel.

Embodiment II

Figure 3B:
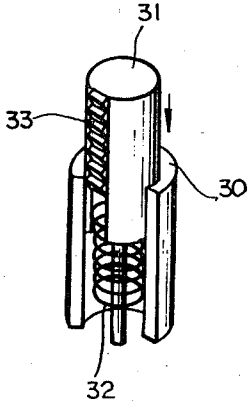
FIG. 3B is a further magnified view of the push button thereof.
Figure 3A:
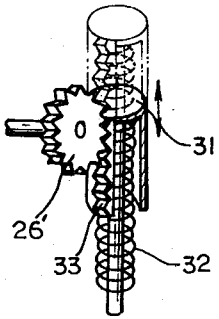
FIG. 3A is an enlarged view of the detachable transmission mechanism of FIG. 2.
Figure 2:
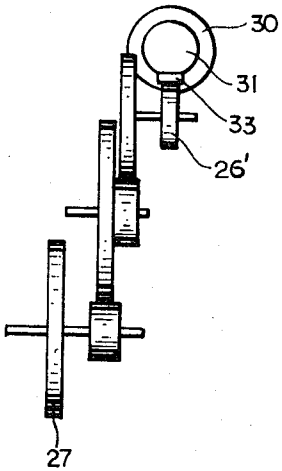
FIG. 2 is a top view of another embodiment according to this invention.

Referring now to FIG. 2, FIG. 3A and FIG. 3B, there is shown a top view of a modification according to this invention, which as well as what is illustrated in Embodiment I, comprises a train of accelerating gears and a flywheel operably mounted to a dynamo. It differs with that in Embodiment I only in that it is operated by pushing a button instead of turning a knob, and replacing the sector gear of the latter by a straight toothing structure.

The Pushing button comprises a cylindrical button (31) whereinto a compression coil spring is incorporated, and a guide seat (30). Button (31) is provided a vertical rack (33) on the side adjacent to the gear train, which rack (33) is positioned in such a manner that when button (31) is released, it engages with pinion (26') all the time before the coil spring resumes its equilibrium point, and disengages therewith immediately when the coil spring reaches its original, unstressed state.

Figure 4:
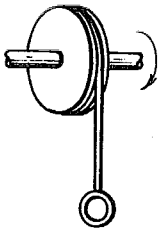
FIG. 4 is a perspective view of a modification of part of the embodiment shown in FIG. 1.

The above two exemplary embodiments, however, does not limit the scope of this invention. For example, the winding knob (21) in Embodiment I can be inferentially substituted by a spool wrapped by a cord such as shown in FIG. 4. In use, the cord is pulled to turn the spool to wind up the spiral spring. The optimal angle of rotation of the sector gear can be accomplished by choosing proper length of the cord.

Although the detaching effect of the mechanical connection according to this invention can also be achieved by using one way freewheel mechanism, this however, will necessitate relatively complicated layout, thus entailing high cost and increasing the probability of trouble thereof.

It will be understood that this invention is susceptible to further modification and, accordingly, it is desired to comprehend such modifications within this invention as may fall within the scope of the appended claims.

I claim:

1. A manually driven generating mechanism for doorbells, comprising:

a dynamo;

a spring;

a means to stress said spring;

a train of acceleration gears mechanically connected to said means;

a clutching device which controls the engagement or disengagement between said means and the first gear of said acceleration gears;

a relatively heavy flywheel, with its two ends respectively connected to the last gear of said acceleration gears, and to the rotary shaft of said dynamo;

a buzzer energized by said dynamo;

said means being able to be conveniently operated by hand to bring said spring into stressed state;

said clutching device enabling said means and the first gear of said accelerating gears to connect mechanically with each other before the stressed spring resumes its original, unstressed position, and to disconnect with each other when said spring reaches its unstressed state;

2. The mechanism according to claim 1, wherein said spring is a spiral spring, whereas said means is a knob.

3. The mechanism according to claim 1, wherein said spring is a coil spring, whereas said means is a pushing button.

4. The mechanism according to any one of claims 1 or 2 in which said clutching device is a sector gear which is so structured and installed that it can mesh with the first gear of said gear train before the stressed spiral spring resumes its unstressed state, and once the spiral spring reaches its unstressed position it will no longer be in mesh with said gear.

5. The mechanism according to any one of claims 1 or 3 in which said clutching device is a rack immovably installed on said pushing button, which rack is so positioned and structured that it can engage with the first gear of said acceleration gear train before the stressed coil spring resumes its unstressed state, and disengage therewith when the coil spring reaches its unstressed position.

6. The mechanism according to claim 1 wherein said spring is a spiral spring, whereas said means is a spool wrapped by a cord.

7. The mechanism according to claim 6 in which said clutching device is a sector gear which is so structured and installed that it can mesh with the first gear of said gear train before the stressed spiral spring resumes its unstressed state, and once the spiral spring reaches its unstressed position it will no longer be in mesh with said gear.

* * * * *